United States Patent [19]

Lyons, Jr.

[11] Patent Number: 4,781,008

[45] Date of Patent: Nov. 1, 1988

[54] FRANE ASSEMBLY FOR BUILDING OPENING

[75] Inventor: George W. Lyons, Jr., Madison, Conn.

[73] Assignee: The Bilco Company, New Haven, Conn.

[21] Appl. No.: 159,479

[22] Filed: Feb. 16, 1988

Related U.S. Application Data

[63] Continuation of Ser. No. 884,413, Jul. 11, 1986, abandoned.

[51] Int. Cl.[4] ..... E04D 13/14

[52] U.S. Cl. ..... 52/656; 52/58; 52/60

[58] Field of Search ..... 52/200, 58, 60, 656, 52/219, 281, 282

[56] References Cited

U.S. PATENT DOCUMENTS

| | | | |
|---|---|---|---|
| 1,840,041 | 1/1932 | Kellogg | 52/200 |
| 2,423,955 | 7/1947 | Widener | 52/281 |
| 2,851,973 | 9/1958 | Stark et al. | 52/200 |
| 3,065,572 | 11/1962 | Weingartner | 52/200 |
| 3,247,632 | 4/1966 | Bloxsom | 52/200 |
| 3,292,323 | 12/1966 | Hagan | 52/282 |
| 3,399,500 | 9/1968 | Shapiro | 52/200 |
| 3,417,527 | 12/1968 | Kiekhaefer | 52/200 |
| 3,434,250 | 3/1969 | Kiekhaefer | 52/200 |
| 3,766,696 | 10/1973 | Totoonchie | 52/282 |
| 3,802,131 | 4/1974 | Resech | 52/200 |
| 3,901,613 | 8/1975 | Andersson | 52/656 |
| 4,409,767 | 10/1983 | Jentoft | 52/200 |
| 4,603,517 | 8/1986 | Lyons, Jr. | 52/60 |

FOREIGN PATENT DOCUMENTS

| | | | |
|---|---|---|---|
| 1509089 | 5/1969 | Fed. Rep. of Germany | 52/200 |
| 2832658 | 2/1980 | Fed. Rep. of Germany | 52/200 |
| 908935 | 11/1945 | France | 52/656 |
| 684055 | 3/1965 | Italy | 52/200 |

*Primary Examiner*—Michael Safavi
*Attorney, Agent, or Firm*—DeLio & Associates

[57] ABSTRACT

A frame assembly for a building opening such as a roof hatch or scuttle, wherein frame elements and integral or separate connecting elements therefor are adapted for on-site assembly and leak-proof securement to a building roof or wall, both manufacture and installation being relatively uncomplicated operations and the resulting structures being adapted to meet high standards of performance.

17 Claims, 6 Drawing Sheets

FRANE ASSEMBLY FOR BUILDING OPENING

This is a continuation of co-pending application Ser. No. 884,413 filed on July 11, 1986 now abandoned.

This invention relates to a frame assembly for a building opening, such as a roof hatch or scuttle, and particularly to the construction of the frame elements and the means for securing them together and to the parts of the building adjacent to the opening thereof.

The curb or wall units can be made in many standard lengths for assembly around roof or wall openings of any width and length, as disclosed below, and the frames can be used in connection with roof domes of the "bubble" type, ventilators, fans, air conditioners, pipe ducts or access openings of any type.

BACKGROUND OF THE INVENTION

In the building construction industry, the basic problems arising in the making of a flat wall, roof or floor are usually minimal so long as the surface is planar and uninterrupted. However, when it is necessary to provide an opening such as a scuttle or hatch, or the like, great care must be taken to ensure the tightness of any seams or joints between the opening and the planar surface. "Flashing" of various types and materials has been used, as disclosed and discussed in applicant's copending application Ser. No. 692,529 filed Jan. 18, 1985, now U.S. Pat. No. 4,603,517, which relates to an improvement in the frame corner flashing construction.

OBJECTS OF THE INVENTION

It is an object of the present invention to provide a hatch frame which can be constructed by the assembly of standard uniform elements, manufactured in one or more sizes and interchangeable in the field, when needed.

It is another object of the invention to provide hatch elements which can be manufactured from materials which are readily available commercially by relatively uncomplicated machine operations, and which can be assembled accurately by operators of normal skill.

It is a further object of the invention to provide hatch elements which can be manufactured for assembly in non-rectangular shape, such as triangular or hexagonal, by the use of standard coupling elements with suitably modified wall portions.

It is a still further object to provide male and female latching members wherever two straight wall portions need to be connected, with the aid of a corner post, if needed, or a junction plate for straight line extensions.

It is yet another object of the invention to provide certain improvements in the form, construction, arrangement and material of the several parts whereby the above-named and other objects may effectively be attained.

The frame assembly includes curb or wall elements adapted to rest on a building roof and to be interconnected at their ends by corner posts or junction plates to constitute a frame of any required size and shape, with auxiliary elements which ensure the provision of a leakproof joint between the hatch or scuttle and the roof surface. Such an auxiliary element may comprise a boot which partially covers the curb or wall elements and is compatable with the roofing material. Specific examples of the types of materials which may be used are discussed below.

DESCRIPTION OF DRAWINGS

Practical embodiments of the invention are shown in the accompanying drawings wherein.

DETAILED DESCRIPTION OF THE DISCLOSURE

Figure 1:
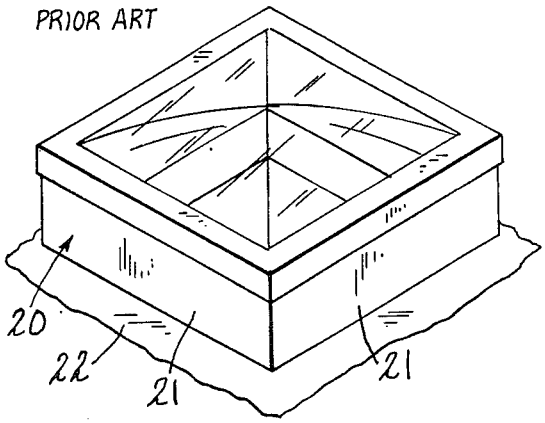
Fig. 1. PRIOR ART
FIG. 1 represents an orthographic projection of a roof hatch in the closed position.
Figure 2:
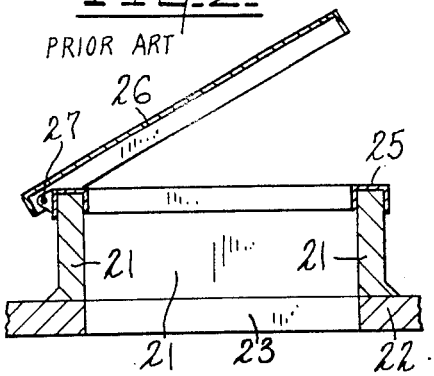
Fig. 2. PRIOR ART
FIG. 2 represents a vertical section of a similar roof hatch with the lid or closure partly open.

Referring to the drawings, a typical roof hatch or scuttle, as shown in FIGS. 1 and 2, comprises a rectangular frame 20 constituted by four vertical wall elements 21 resting on the surface of the roof 22 around the margins of an opening 23, the bottom edges of the wall elements being nailed and/or adhesively secured to said surface and their corners being formed in accordance with any good carpentry practice. The upper rim of the frame may suitably be finished by the provision of a channel 25 of metal or other material, and the lid 26 may simply rest on the wall, as in FIG. 1, or be hinged thereto as indicated at 27 in FIG. 2. In either case the lid should fit snuggly, and hook or latch means (not shown) are usually provided, to prevent displacement.

Figure 3:
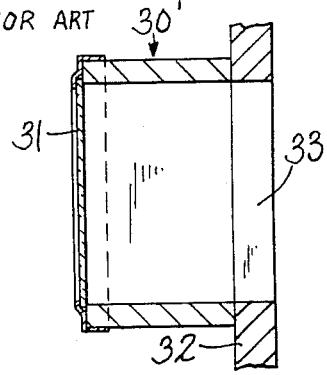
Fig. 3. PRIOR ART
FIG. 3 represents a vertical section of a hatch or scuttle applied to a wall opening, instead of a roof.

Since there may be situations where a hatch or scuttle is needed in a more or less vertical building wall, instead of a roof, such a construction is shown in FIG. 3 where the frame 30, with lid 31 is mounted on a building wall 32 around an opening 33. Structural details discussed hereinafter are applicable not only to the construction of roof hatches or scuttles, as shown in FIGS. 1 and 2, but also to building wall hatches, as in FIG. 3, unless otherwise noted or obviously inapt.

Figure 4:
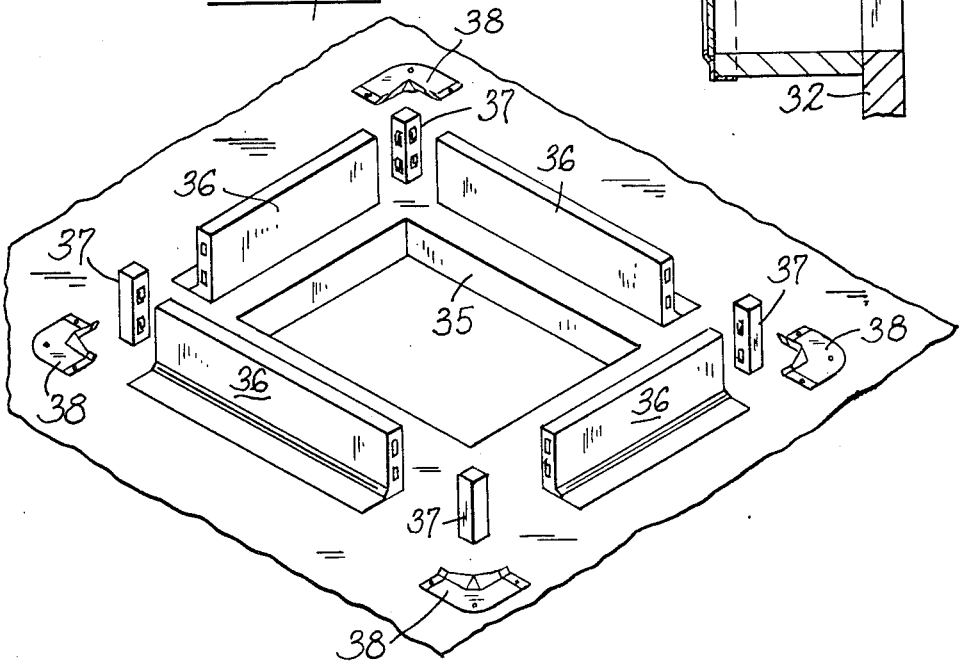
FIG. 4 represents an exploded view of a hatch assembly, showing the parts to be assembled.
Figure 5:
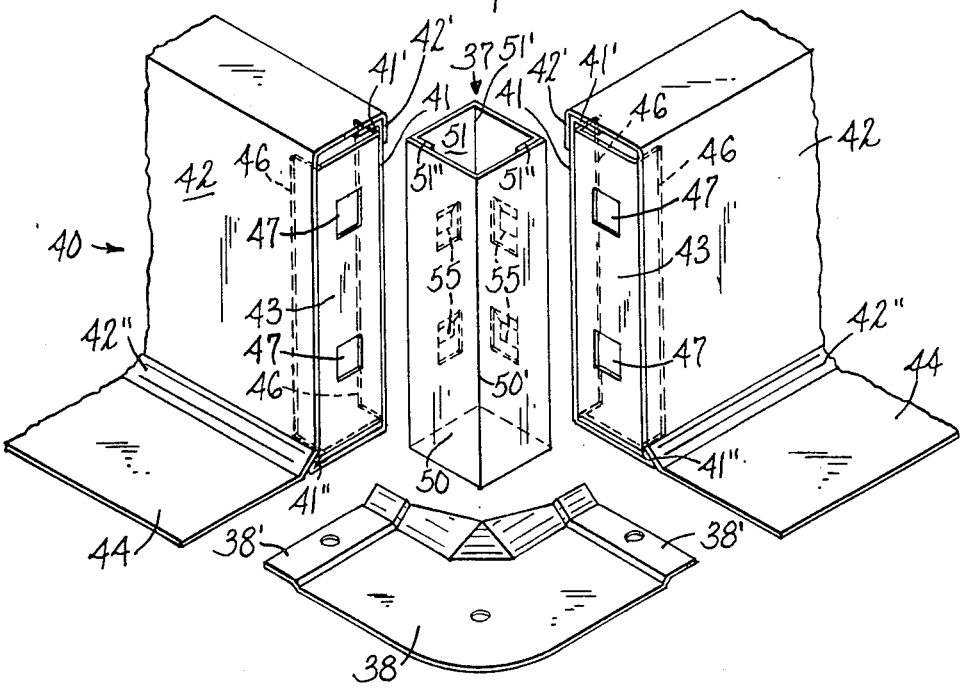
FIG. 5 represents a detail exploded view on a larger scale of a right-angle corner construction, parts being broken away.

As shown in FIG. 4, in accordance with the invention, the parts to be assembled around the opening 35 include the curb or wall elements 36, the corner posts 37 and the corner flashing shields 38, all as shown in more detail in FIG. 5.

Each curb or wall element 40 is shown as being fabricated from two metal shapes 41, 42 and an end plate 43. The inner shape 41 is generally L-shaped in cross-section, with a small right angled flange 41' at the top and an acute angled flange 41'' at the bottom. The outer shape 42 is bent to form the top edge of the wall and its outer surface, with a right angled flange 42' adapted to overhang the top of the inner shape and a 45° angled strip 42'' adapted to rest on the flange 41'' of the inner shape 41, while the integral flashing strip 44 is constituted by a flat extension of shape 42 beyond the angled strip 42''. Each end plate 43 is vertically elongated and is provided with narrow flanges 46 and with apertures 47 adapted to permit engagement with the corner post. The parts just described are suitably made of strip metal and are assembled by welding the overlapping contacting surfaces of the inner and outer shapes into tubes of rectangular cross-section and then welding the flanges 46 of the end plate to the adjacent vertical walls of the inner and outer shapes, all as clearly shown in FIG. 5.

Each corner post 37 is shown as being fabricated from two metal strips, 50 and 51, the strip 50 being bent longitudinally to form a right-angled corner 50' and the strip 51 being folded similarly to form the corner edge 51' between flat panel surfaces and also having its free edges folded to form flanges 51'' which can be welded to edge portions of the strip 50 to form a square tube. Each flat panel surface of strip 51 is provided with stamped, offset, fingers 55 which are sized and located to engage in the apertures 47 of a wall element end plate. Two fingers in each panel surface are shown as the preferred structure, but one finger or more than two fingers could be provided, if desired.

Figure 6:
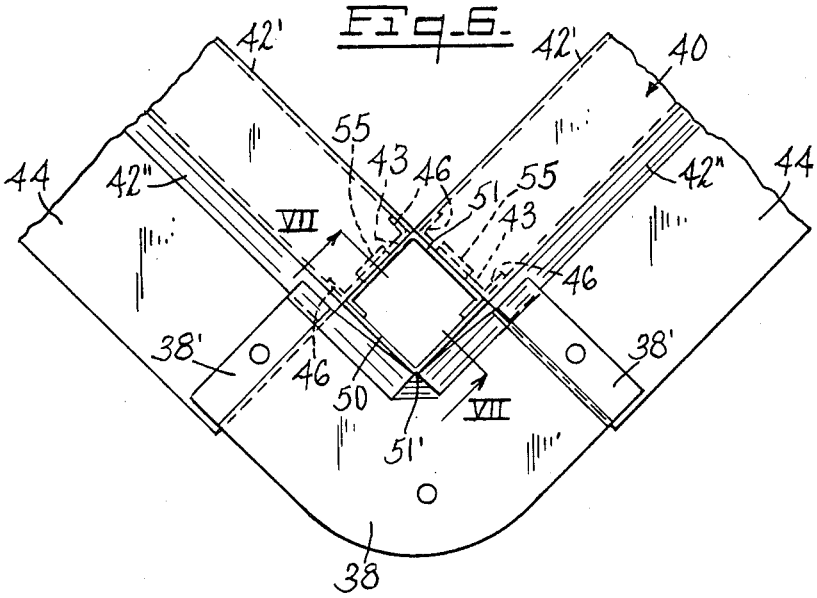
FIG. 6 represents a detail top plan view of the parts shown in FIG. 5, in their assembled position.

When the curb or wall elements 40, shown in FIG. 5, have been assembled with the corner post 37, by engagement of the fingers 55 on the corner post in the apertures 47 of the end plate 43, the parts will appear as in FIG. 6, and the corner flashing shield 38 can be added, as described in copending patent application Ser. No. 692,529, the end flanges 38' of the shield being welded or otherwise secured to the edges of the flashing strip 44 which the shield overlaps.

Figure 7:
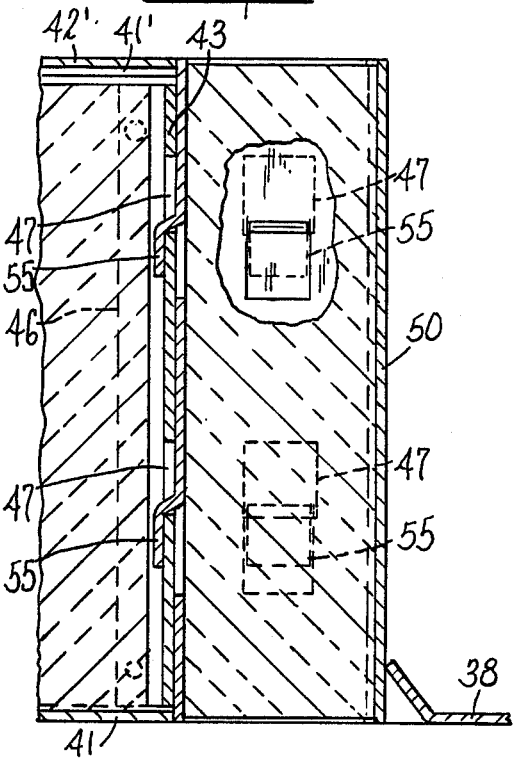
FIG. 7 represents a detail vertical section on the line VII—VII of FIG. 6, parts being broken away.
Figure 8:
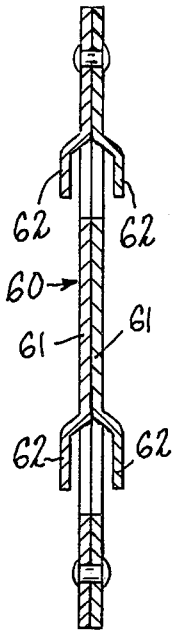
FIG. 8 represents a detail vertical section through a junction plate constituted by two male connecting plates riveted together, back-to-back.

FIG. 7 shows on a larger scale the engagement of the corner post 37 with the ends of adjacent wall elements, as just described.

Figure 9:
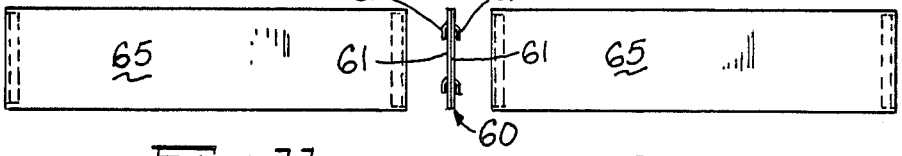
FIG. 9 represents an elevation, exploded, of two hatch wall elements and the junction plate by which they are to be connected.

If the aperture, in a roof or buidling wall, is large enough to require the use of a plurality of curb or wall elements on two or more sides, elements constructed as shown and described above can be assembled end-to-end by the use of a junction plate 60, constituted by two plates 61, each having fingers 62 (like the fingers 55 on the corner posts), the plates being riveted or welded together, back-to-back, so that the fingers can be engaged in apertures such as 47, in the ends of curb or wall elements 65 (FIG. 9) to be connected end-to-end, for the construction of an elongated curb or wall. .

Figure 10:
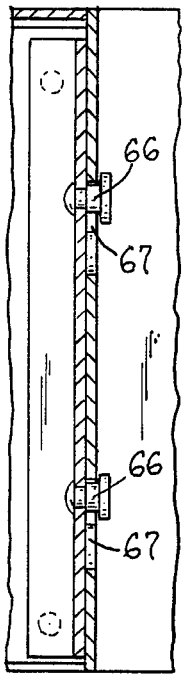
FIG. 10 represents a detail vertical section through a modified form of connecting plate.

While the stamped and offset fingers shown in FIGS. 4 to 8 are presently considered to be a preferred form of joining means, the alternative shown in FIG. 10 might be desired in some situations. Here the male member comprises a headed stud 66 in one element, adapted to engage in a keyhole slot 67 in the mating element.

Figure 11:
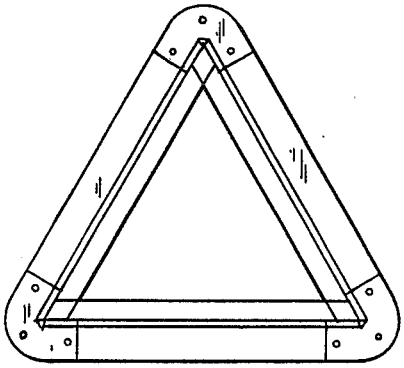
FIGS. 11 and 12 represent top plan views of hatch cover elements which are assembled in non-rectangular shapes, namely, triangular and hexagonal, respectively, by the use of special corner posts.
Figure 12:
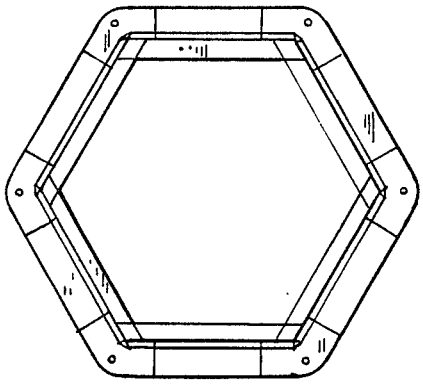

While scuttle or hatch opening in roofs or walls are generally rectangular and adapted for finishing with the aid of curb or wall elements and corner posts or junction plates as shown in FIGS. 4 to 9, the provision of standard curb or wall panel elements with apertured end plates makes it possible to frame apertures of varied geometrical outlines, by providing special corner posts with their finger-bearing sides disposed at selected angles of other than 90°. Examples are shown in FIGS. 11 and 12 where the corner angles are, respectively, 60° and 120°, forming frame assemblies of triangular and hexagonal outline, by way of example.

Important adjuncts of the interlocking frame assemblies described above are shown in FIGS. 13 to 18 which illustrate certain unique possibilities of cooperation of the new curb or frame assemblies and their associated flashings, with specific roofing materials and structures. The materials currently used fall mainly into four categories:

1. Elastomeric materials, including natural and synthetic rubber and latex products, in sheet form, adapted for application to roof surfaces by the use of adhesive.
2. Plastic polymers, such as PVC and CPE, which can be bonded or solvent sealed, particularly on stiff (non-resilient) flashings and other surfaces.
3. Coatings which can be flame applied to bare metal.
4. Coatings which can be flowed or sprayed, or applied as foam.

Figure 13:
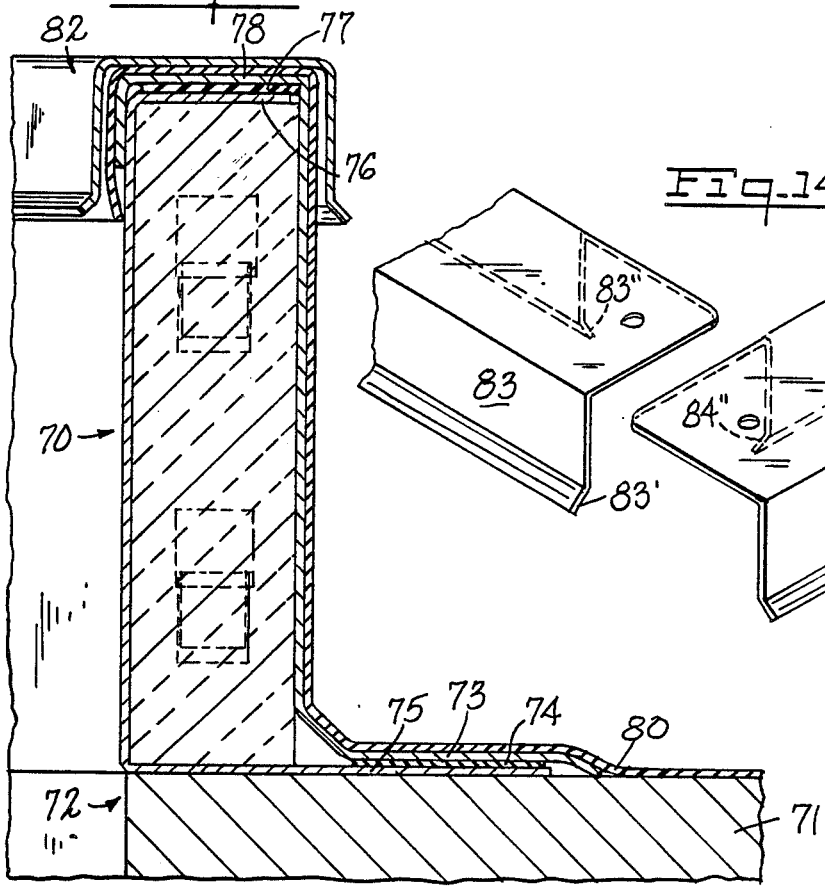
FIG. 13 represents a detail vertical section through a hatch wall which is effectively covered with a laminar extension of the roofing material, the hatch wall being covered by a cap which finishes the top of the wall.

In FIG. 13 is shown a curb or wall assembly 70 similar to that shown at 40 in FIG. 5, installed on a roof 71 adjacent a roof opening 72. The curb has an integral flashing strip 73, like the strip 44 in FIG. 5, which overlies a thermal break 74 resting on the extension 75 of the shape 76. This shape is modified from the shape 41 (FIG. 5) by eliminating the narrow flange 41'' to form the extension 75 and the upper flange 41' is extended to form the horizontal extension 76 on which a second thermal break 77 is placed, beneath the top horizontal run 78 of the shape 73.

Figure 14:
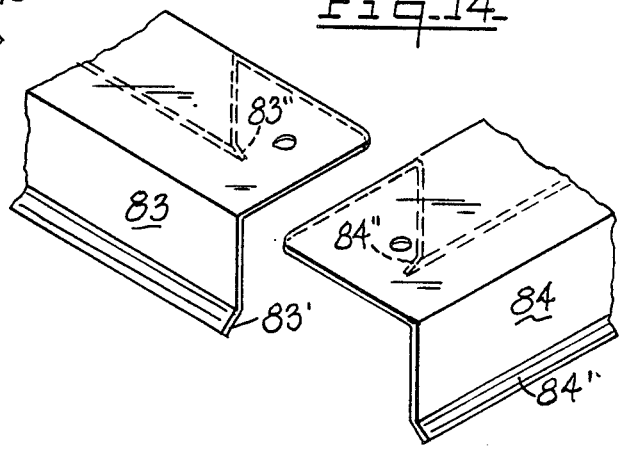
FIG. 14 represents a detail orthographic projection of the end portions of channel-forming strips, in separated position.
Figure 15:
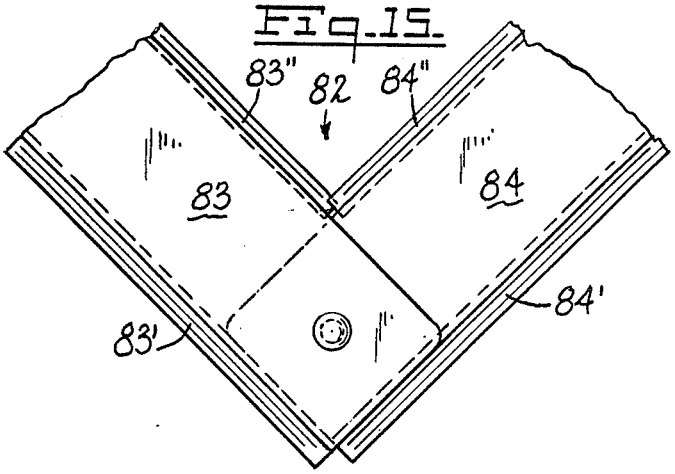
FIG. 15 represents a detail top plan view of the corner joint formed by the assembly of the parts shown in FIG. 14.

As shown in FIG. 13, the roll roofing material 80 whatever its nature, is extended to constitute a curb flashing, covering the curb and terminating on the inside face of the curb. A cap 82 is provided to hold the curb flashing in place, the cap being an inverted channel formed from channel strips 83, 84 which may be interfitted at their ends, as shown in FIGS. 14 and 15, to form corners. Each downwardly projecting side edge of the channel is preferably bent out, as shown at 83'', 84'', to facilitate installation on the top of the curb.

Figure 16:
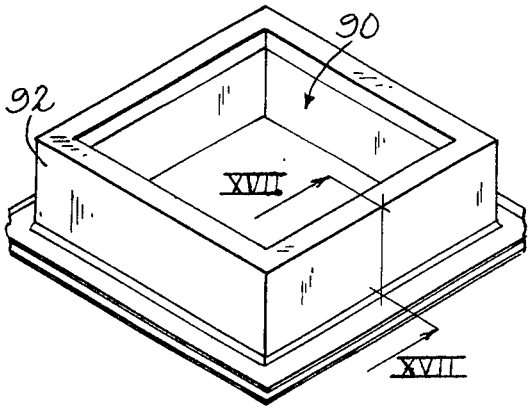
FIG. 16 represents an orthographic projection of a hatch wall which is provided with a molded rubber boot.
Figure 17:
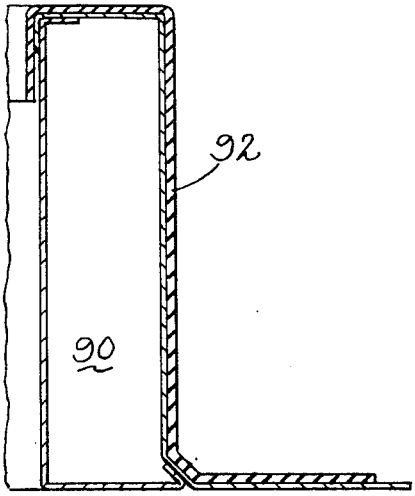
FIG. 17 represents a vertical section on the line XVII—XVII in FIG. 16.

FIGS. 16 and 17 show a curb or wall 90 (like that shown in FIGS. 5 and 6) on which has been fitted a molded boot flashing 92 which may be made in standard sizes to fit corresponding sized curb or wall assemblies. The boot is one-piece and is made of a material which is compatable with the roll roofing material, elastomeric or plastic, to which it may be sealed in an appropriate manner.

Figure 18:
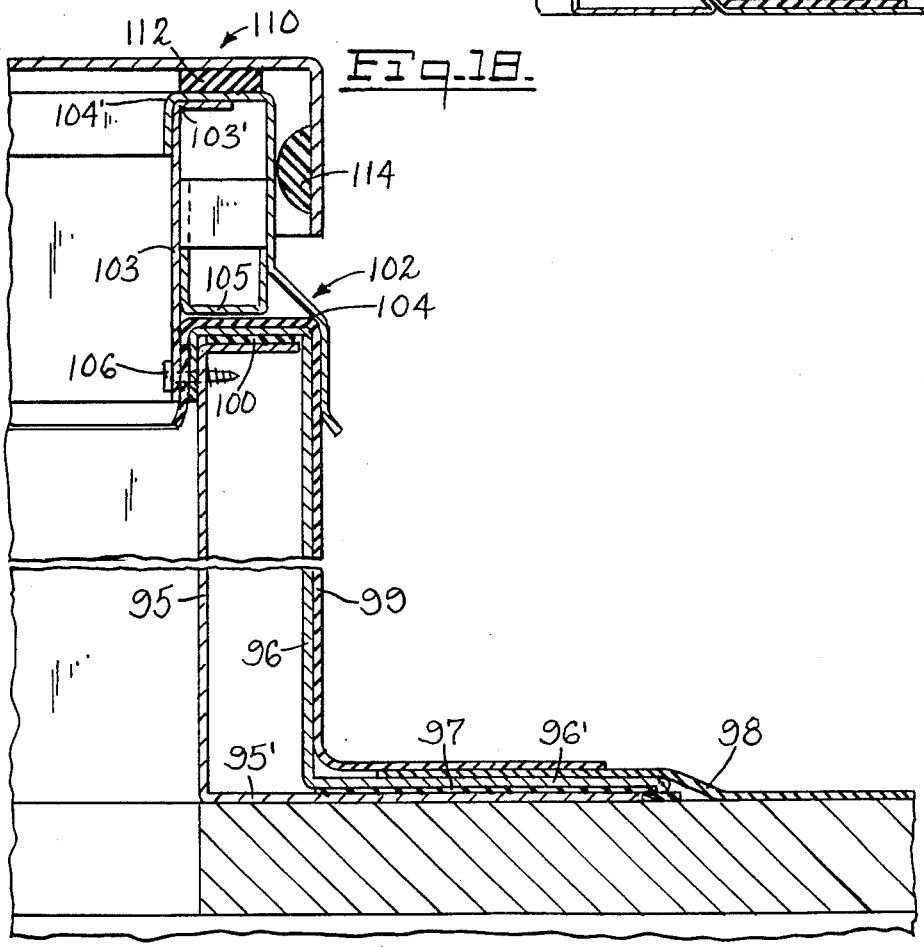
FIG. 18 represents a detail vertical section through a hatch or scuttle wall and cover, wherein the wall is provided with an added adapter rim.

In the assembly shown in FIG. 18, the inner shape 95 and outer shape 96 both have flashing extensions 95' and 96' which join the vertical walls with right-angle bends (not bevels, as in FIGS. 5, 7 and 13) and extend substantially equal distances outward. A layer 97 of insulating material is sandwiched between the extensions and the roll roofing material 98 overlies them, as shown. A molded boot flashing 99, pre-formed and of a material similar to and compatible with the roll roofing material fits over the entire curb or wall assembly, and an additional layer of insulation 100 may usefully by interposed between the upper horizontal rims of the inner and outer shapes.

FIG. 18 also shows a curb cover 102 constituted by a frame built up from inner and outer shapes 103 and 104, joined at their upper angles 103' and 104', and completed by an inverted channel member 105. The curb cover is intended to be fitted on the top of the curb or wall and fixed thereon as by means of self-threading screws 106, so that the boot flashing 99 is held firmly in place between the downwardly projecting skirt portions of the cover. A curb or hatch lid 110, of any desired construction completes the assembly, the lid shown being in the form of a simple tray with a flat sealing strip 112 in position to rest on the curb cover and an additional seal or seals 114 inside the depending flange of the lid.

Figure 19:
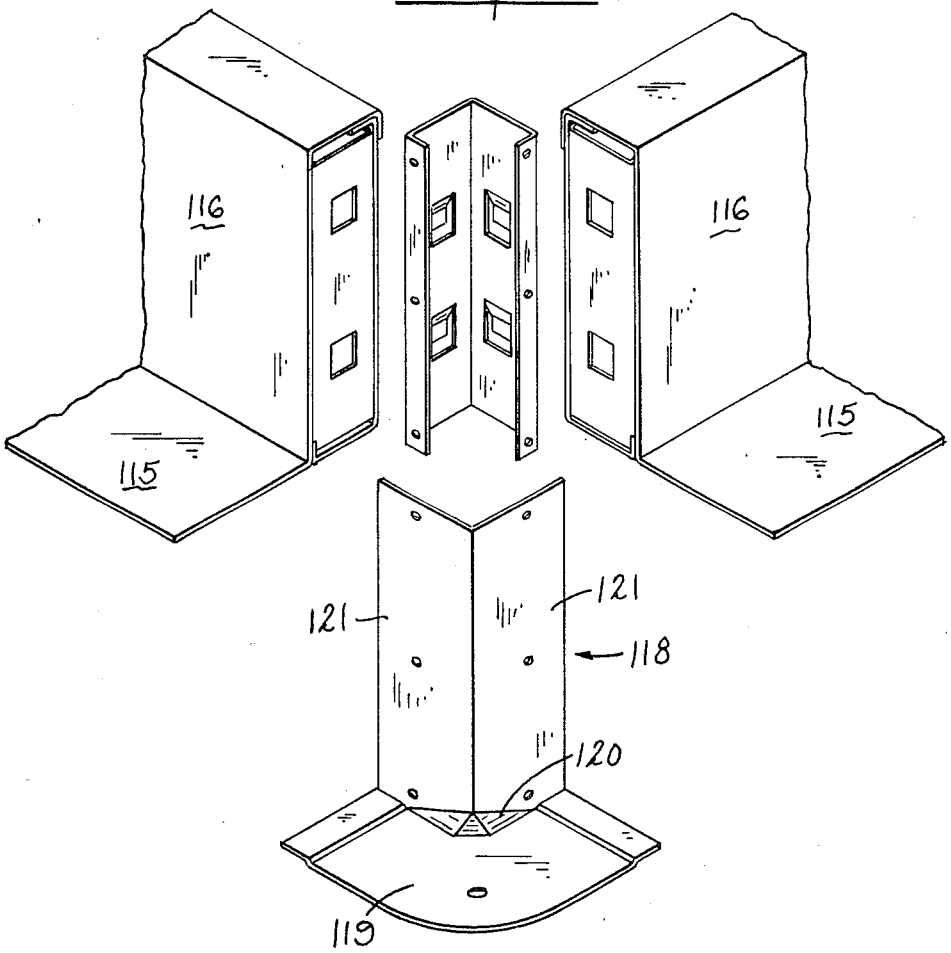
FIG. 19 represents a detail exploded view, similar to FIG. 5, showing modified or alternative forms of certain elements.

The assembly shown exploded in FIG. 19 is like that shown in FIG. 5, except that the flashing extensions 115 extend at a right angle to the side walls 116, as in FIG. 18 instead of having a bevel connection as in FIGS. 5, 7 and 13. The corner post 118 is correspondingly modified and includes an integral flashing shield 119 and transition area 120 between the shield and post outer walls 121, all of which can be formed of sheet metal by suitable stamping and welding operations or the entire post unit can be molded of an appropriate plastic material.

From the foregoing it will be understood that the invention includes the provision of curb or hatch frame elements which can be shipped knocked down for ease in handling, storage and shipment, the parts to be job-assembled in a relatively uncomplicated manner.

The curb framing elements can be fabricated in many types of materials including laminated plastic and metal. When precoated laminates of roofing fabric and metal are used, corner patches of compatible roof fabric can be lapped over each corner and heat sealed or solvent welded at the job site.

When materials such as steel, aluminum, copper, stainless steel and the like are used for the curb-frame system without a factory-applied laminated coating of a plastic type material, then a pre-molded one-piece plastic boot, as shown in FIG. 16, should be provided, the material of the boot being the same as, or compatible with, the roofing material. Such a boot can be collapsed for shipment in a compact form with the rigid frame elements and facilitates assembly at the job site.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

What I claim is:

1. A frame assembly for surrounding an opening in a building surface and for adhering to a waterproof building surface membrane comprising:

a plurality of elongated curb elements, each curb element having an upper edge, a lower edge and end surfaces, each said lower edge being provided with a laterally projecting flashing strip, each said end surface being provided with means for securement to an adjacent element, said means for securement comprising an aperture; and a plurality of corner posts, each corner post having at least two side surfaces, and each side surface being provided with means for securement to an end surface of a curb element, said means for securement comprising an offset finger sized and located to engage in a curb end aperture;

said curb elements and corner posts being collapsible for shipment and assemblable to form the frame;

said curb elements being provided with a frame membrane material suitable for adhering to the waterproof building surface membrane.

2. A frame assembly according to claim 1 wherein each curb element comprises at least two preformed shapes secured together to form a tube of rectangular cross-section, at least one shape having said laterally projecting flashing strip integrally formed along a lower edge of said at least one shape.

3. A frame assembly according to claim 2 wherein a substantially 45° angled strip is provided along said lower edge of said at least one shape.

4. A frame assembly according to claim 2 which includes a cap adapted to fit over the upper edge of the curb element, said cap being an inverted channel shaped and sized to fit the curb elements after assembly of the frame.

5. A frame assembly according to claim 4 wherein the other of said at least two shapes has a laterally projecting flashing strip integrally formed along a lower edge of said other shape.

6. A frame assembly according to claim 1 which includes a plurality of corner posts adapted to be interconnected with the ends of adjacent curb elements and a corner flashing shield associated with each corner post.

7. A frame assembly according to claim 6 wherein each flashing shield is adapted to overlap a portion of an adjacent flashing strip.

8. A frame assembly according to claim 1 which includes a junction plate, said plate being provided with means for engaging the end surfaces of curb elements for connecting said elements in end-to-end relationship.

9. A frame assembly according to claim 1 which includes a body of insulating material adjacent to said upper edge of the curb element.

10. A frame assembly according to claim 1 which includes a body of insulating material adjacent to said laterally projecting flashing strip.

11. A frame assembly according to claim 1 which includes a curb cover shaped and sized to fit the curb elements after assembly of the frame.

12. A frame assembly according to claim 11 wherein the curb cover comprises at least two preformed shapes arranged to provide downwardly projecting skirt portions adapted to fit on the upper edge of the curb elements after assembly of the frame.

13. A frame assembly according to claim 1 wherein each curb element lower edge and each corner post is provided with a laterally projecting integral flashing strip.

14. A frame assembly according to claim 1 wherein the curb elements and flashing strips are formed from a laminate material comprising sheet metal laminated to the frame membrane material, whereby the frame membrane material is provided on the exterior of the curb elements and the flashing strips for adhering to the building surface membrane.

15. A frame assembly according to claim 1 wherein the frame membrane material comprises a one-piece molded boot adapted to cover the upper edge of the assembled curb elements and at least a portion of the flashing strip.

16. A frame assembly according to claim 1 wherein each curb element has a uniform substantially rectangular cross-section.

17. A frame assembly for surrounding an opening in a building surface and for adhering to a waterproof building surface membrane comprising:

a plurality of elongated curb elements, each curb element having an upper edge, a lower edge and end surfaces, each said lower edge being provided with a laterally projecting flashing strip, each said end surface being provided with means for securement to an adjacent element a plurality of corner posts, each corner post having at least two side surfaces, and each side surface being provided with means for securement to an end surface of a curb element; and a junction plate, said plate being provided with means for engaging the end surfaces of curb elements for connecting said elements in end-to-end relationship, said curb elements and corner posts being collapsible for shipment and assemblable to form the frame;

said curb elements being provided with a frame membrane material suitable for adhering to the waterproof building surface membrane.

* * * * *

UNITED STATES PATENT AND TRADEMARK OFFICE

CERTIFICATE OF CORRECTION

PATENT NO. : 4,781,008

DATED : November 1, 1988

INVENTOR(S) : George W. Lyons, Jr.

It is certified that error appears in the above-identified patent and that said Letters Patent is hereby corrected as shown below:

In the Title, on the First Page and in Column 1, Line 2

Delete "FRANE ASSEMBLY" and substitute --FRAME ASSEMBLY--.

Signed and Sealed this

Fourteenth Day of March, 1989

*Attest:*

DONALD J. QUIGG

*Attesting Officer*

*Commissioner of Patents and Trademarks*